United States Patent [19]

Yoshimura

[11] Patent Number: 4,965,595

[45] Date of Patent: Oct. 23, 1990

[54] PRINTING HEAD OF COLOR INK JET PRINTER

[75] Inventor: Hisashi Yoshimura, Nara, Japan

[73] Assignee: Sharp Kabushiki Kaisha, Osaka, Japan

[21] Appl. No.: 850,625

[22] Filed: Apr. 11, 1986

[30] Foreign Application Priority Data

Apr. 15, 1985 [JP] Japan ..... 60-80484

[51] Int. Cl.[5] ..... B41J 2/045; B41J 2/21; B41J 2/175

[52] U.S. Cl. ..... 346/140 R

[58] Field of Search ..... 346/140, 75

[56] References Cited

U.S. PATENT DOCUMENTS

| | | | |
|---|---|---|---|
| 4,320,406 | 3/1982 | Heinzl | 346/140 |
| 4,460,906 | 7/1984 | Kanayama | 346/140 |
| 4,511,907 | 4/1985 | Fukuchi | 346/140 |
| 4,516,139 | 5/1985 | Takiguchi | 346/140 |
| 4,521,788 | 6/1985 | Kimura | 346/140 |

FOREIGN PATENT DOCUMENTS

| | | |
|---|---|---|
| 2161315 | 6/1973 | Fed. Rep. of Germany . |
| 3037774 | 6/1982 | Fed. Rep. of Germany . |
| 2808429 | 8/1982 | Fed. Rep. of Germany . |
| 3515514 | 11/1983 | Fed. Rep. of Germany . |

*Primary Examiner*—Joseph W. Hartary

[57] ABSTRACT

A specific number of orifices corresponding to the respective ink colors are provided for the printing head of an on-demand color jet printer in which orifices dealing with respective color ink are divided into orifice groups each being provided with a plurality of orifices. The orifices in the orifice groups dealing with respective color inks are designed to allow the supply of color inks through a plurality of ink paths each being independently provided and having a specific length. This configuration allows the entire system to stably execute a printing operation without being affected by the acceleration force applied to the printing head when driving the printing head at an extremely fast speed, which adversely affects the supply of ink to these orifices.

3 Claims, 4 Drawing Sheets

PRINTING HEAD OF COLOR INK JET PRINTER

BACKGROUND OF THE INVENTION

The present invention relates to a printing head of an ink-jet printer, more particularly, to an improved printing head of the on-demand type ink-jet printer. In conjunction with color ink jet printers that execute printing of multi-colored figures and characters, one of the prior arts proposes an on-demand type ink-jet printer which prints multi-colored figures and characters using four colors of internally stored ink, yellow, magenta, cyan, and black.

However, the on-demand type color ink jet printers available today still have a problem to solve in their constitution related to the conduction part connected to the orifice. Actually, when driving the printing head at high velocity, ink flowing through the conduction part is accelerated, and eventually overflows from the orifice due to the intense acceleration force.

SUMMARY OF THE INVENTION

The present invention aims at providing a ink-jet printer that safely prevents ink from overflowing from of the orifice even when the printing head of an on-demand type color ink jet printer is driven at an extremely fast speed during printing.

Other objects and further applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from the following detailed description.

One of the preferred embodiments of the present invention is a plurality of orifice groups provided on the printing head, each containing a plurality of orifices that channel different color inks stored in the printer unit. The plural orifices in each orifice group allow the passage of corresponding color inks from independently provided ink paths having a specific length. Since each orifice is connected to a separate ink path, the broad chamber, which connects the orifices with the ink path, provided in a conventional printer can be eliminated. As a result, the influence of the accelerated printing head is securely minimized when feeding ink to a plurality of orifices while driving the printing head at high velocity, and at the same time, the uneven supply of ink between a plurality of orifices inherent to the conventional printing head can be eliminated. Consequently, the printing head embodied in the present invention securely prevents ink from being oversupplied to the orifices as a result of uneven ink distribution, making the printer ideally suited for high-speed operation.

BRIEF DESCRIPTION OF THE DRAWINGS

The present invention will be better understood from the detailed description given hereinbelow and the accompanying drawings which are given by way of illustration only, and thus are not limitative of the present invention wherein.

DESCRIPTION OF THE PREFERRED EMBODIMENTS

Figure 1:
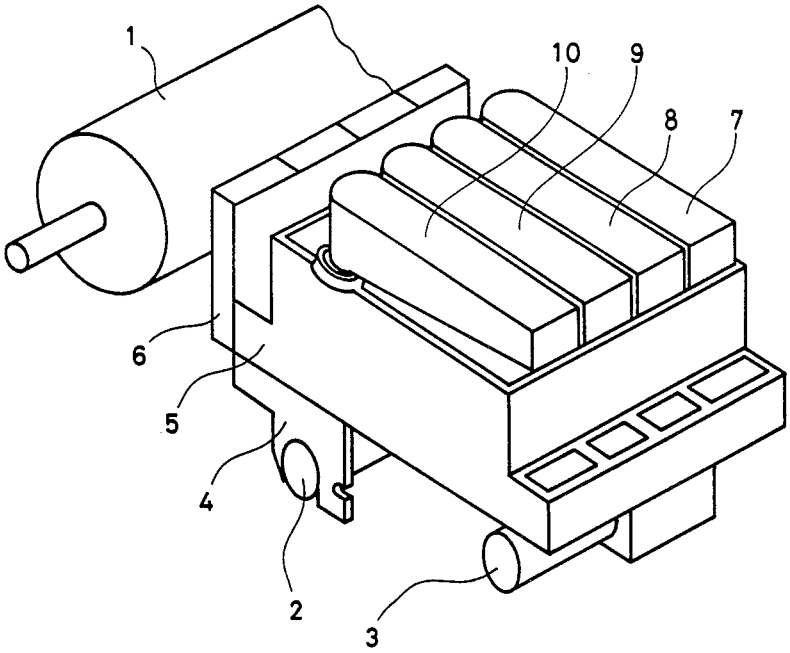
FIG. 1 is a perspective view of the essential part of a color ink jet printer.

FIG. 1 represents the overall perspective view of an on-demand color ink jet printer. A pair of parallel shafts 2 and 3 are installed in front of a platen roller 1, while a carriage 4 is supported by these shafts 2 and 3 along the platen roller 1 so that the carriage 4 can freely move in the lateral direction. The carriage 4 is connected to a pulse motor (not shown) by means of a wire so that the carriage 4 can be driven by rotation of this motor to allow printing operation when the carriage 4 moves to the right. In addition, an ink tank 5 mounted on the carriage 4 stores 4 colors of ink separately. A printer head 6 comprising 4 different color units is provided in front of an ink tank 5, facing the platen roller 1. Four ink cartridge units 7 through 10 are located in the ink-tank 5. The reference numerals 7 through 9 respectively denote ink cartridges each containing yellow, magenta, and cyan color ink discretely. Multi-colored picture elements are generated by blending these three-primary-color inks on the printing medium. In addition, black ink is also provided in the ink-cartridge 10.

Figure 2:
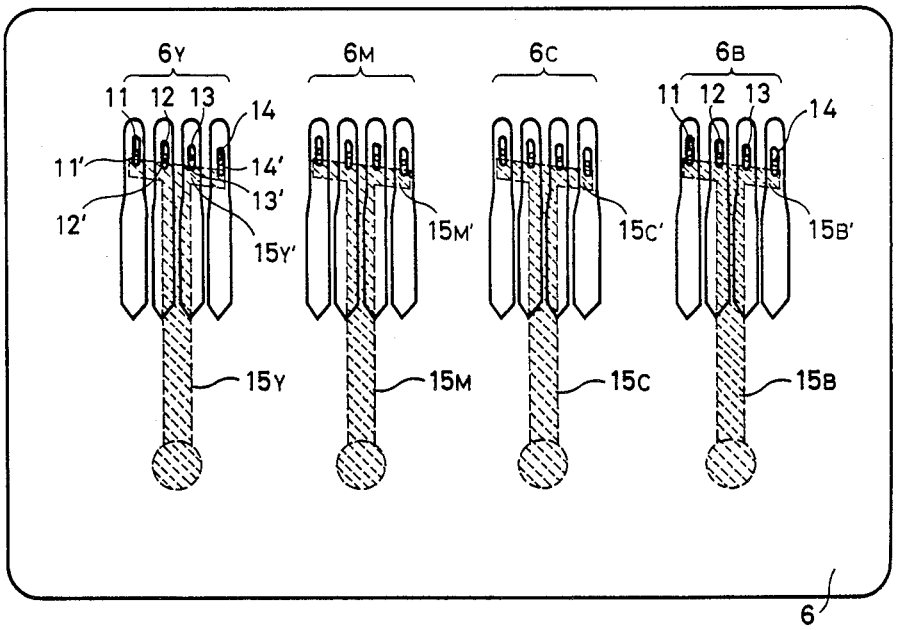
FIG.2 PRIOR ART
FIG. 2 is a front view of a conventional printing head.

The present invention relates to the novel constitution of the printing heads 6 cited above. To facilitate understanding of the principles of the present inventions, the configuration of a conventional printing head is described below. Now referring to FIG. 2, an orifice group 6Y containing four units of yellow orifices, an orifice group 6M containing four units of magenta orifices, an orifice group 6C containing four units of cyan orifices, and an orifice group 6B containing four units of black orifices, are sequentially disposed from left to right in the printing direction (facing the platen roller), while orifices 11 through 14 are respectively disposed in a specific tilt angle, corresponding to 4 printing picture-element dots in the vertical direction. The orifices are disposed at specific intervals corresponding to 8 dots in the horizontal direction. In addition, orifices of each certain number are aligned horizontally with orifices of the same number in respective orifice group. These orifice groups 6Y, 6M, 6C, and 6B are discretely connected to the ink-tank 5 storing color inks that correspond to these orifice groups. Taking the example of the orifices 11 through 14 of the orifice group 6Y, the color inks are respectively led to ink pools 11' through 14' provided in front of the orifices 11 through 14 from the yellow ink-tank via a commonly available ink path 15Y. To connect the ink path 15Y to ink pools 11' through 14', a connecting chamber 15Y' having a specific width large enough to cover these ink pools 11' through 14' is provided. Likewise, for the orifice groups 6M, 6C, and 6B, the inks are respectively led to ink pools 11' through 14' provided in front of the orifices 11 through 14 via the ink paths 15M, 15C, and 15B, and in addition, each orifice group is provided with a connecting chamber 15M', 15C', and 15B' each having a specific width large enough to cover the ink pools 11' through 14'.

Consequently, since each orifice group 6Y, 6M, 6C, and 6B comprising orifices 11 through 14 are respectively need to feed corresponding color inks via the ink paths 15Y, 15M, 15C, and 15B installed in the printing head 6, the system is obliged to use a connecting chamber 15Y', 15M', 15C', and 15B'each having a specific width large enough to cover orifices 11 through 14 of respective groups. When operating a conventional printer, the printing head 6 performs reciprocating operations in the lateral direction at high velocity over the surface the platen roller 1 while printing operation is underway. When the printing head 6 moves in both directions, acceleration force G is applied to inks which flow through ink paths 15Y, 15M, 15C, and 15B inside the printing head 6. In particular, there is a significant difference in the amount of supplied ink between the orifices 11 and 14, thus eventually causing color ink to overflow from those orifices which are subjected to said force G. Although this is not a critical problem when the printing head performs reciprocating movement at a relatively slow speed, this is no longer a negligible problem in the light of growing needs for faster printing operation today.

Figure 3:
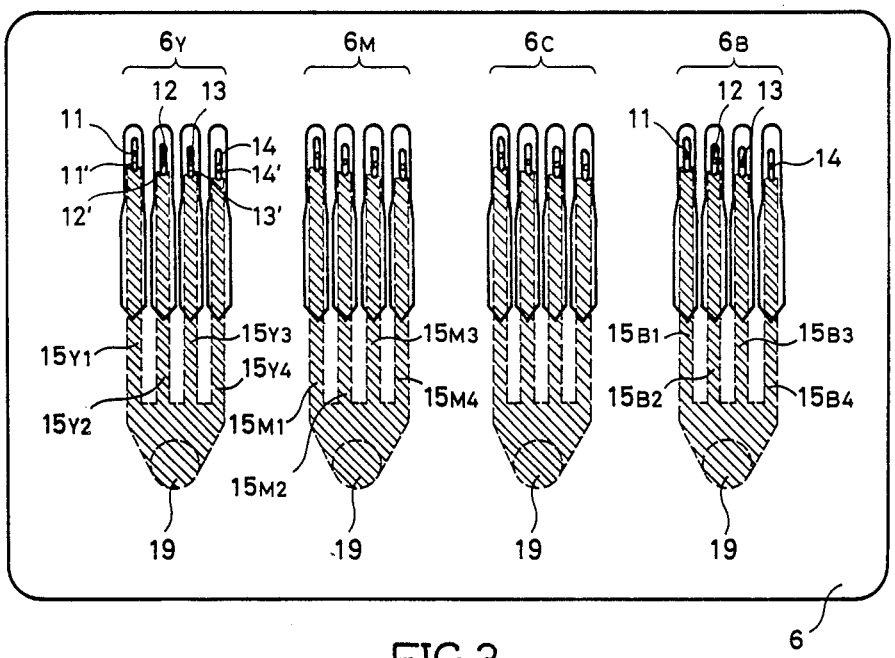
FIG. 3 is a front view of the printing head reflecting one of the preferred embodiments of the present invention.
Figure 4:
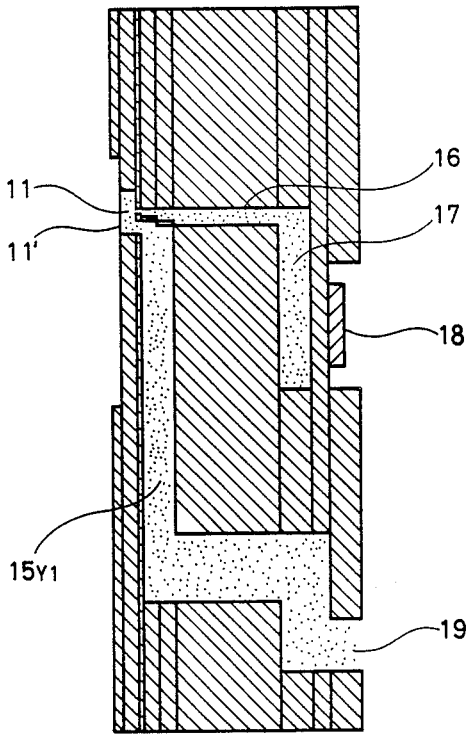
FIG. 4 is a sectional view of the printing head shown in FIG. 3.

FIG. 3 is the front view of the printing head of the on-demand ink-jet printer reflecting one of the preferred embodiments of the present invention. FIG. 4 is the sectional view of the printing head shown in FIG. 3. In FIG. 3, the printing head 6 is provided with the yellow orifice group 6Y, the magenta orifice group 6M, the cyan orifice group 6C, and the black orifice group 6B from left to right on its front side. Each of these orifice groups is provided with four orifices 11 through 14 which are respectively disposed in a specific tilt angle which corresponds to four printing picture-element dots in the vertical direction. And the orifices are disposed at specific intervals corresponding to 8 dots in the horizontal direction. In addition, orifices of each specific number, 11 through 14, are aligned horizontally with orifices of the same number in respective orifice groups Such configurations are identical to those of any conventional printing head shown in FIG. 2.

The printing head 6 reflecting the present invention is also provided with the orifices 11 through 14 of the orifice groups 6Y, 6M, 6C, and 6B. Corresponding color inks are led to the printing head through independently provided ink paths $15Y_1$ through $15Y_4$, $15M_1$ through $15M_4$, $15C_1$ through $15C_4$, and $15B_1$ through $15B_4$ via ink pools 11' through 14' corresponding to the orifices 11 through 14.

Concretely, ink paths $15Y_1$ through $15Y_4$ respectively extend downward from corresponding ink pools 11' through 14', while the bottom edges of these ink paths $15Y_1$ through $15Y_4$ are commonly connected to an ink supply path 19 of the ink tank storing yellow ink. In the same way, the printing head 6 is also provided with ink paths $15M_1$ through $15M_4$, $15C_1$ through $15C_4$, and $15B_1$ through $15B_4$. FIG. 4 shows the sectional view of the printing head 6 incorporating these ink paths. The printing head 6 embodied by the present invention is made of a plurality of stainless steel members stacked in layers which are integrally joined, while ink paths and chambers are made by etching. In FIG. 4, the ink pool 11' is provided in front of the orifice 11 which is connected to a pressure chamber 17 via a passage 16, while a piezoelectric vibrator 18 is installed on a side wall of the pressure chamber 17. An ink path ($15Y_1$ for example) extends downward from the bottom part of the ink-pool 11'. The bottom end of the ink path $15Y_1$ is connected to the ink tank storing yellow ink via the common ink-supply path 19. FIG. 4 typically represents the configuration of the orifice 11 which is, for example, a constituent of yellow orifice group 6Y. Likewise, the other orifices 12 through 14 are also respectively provided with pressure chambers, piezoelectric vibrators, and independent ink paths $15Y_2$ through $15Y_4$. In addition, identical configurations are also provided for magenta orifice group 6M, cyan orifice group 6C, and black orifice group 6B. Consequently, when the piezoelectric vibrator 18 shown in FIG. 4 is activated, the volume of the pressure chamber 17 decreases. This pressure increase is conveyed to the orifice via the passage 16 thus causing ink drops to be jetted out of the orifice 11 before eventually arriving at the surface of the printing paper via the ink pool 11'.

The on-demand color ink jet printer incorporating the printing head 6 reflecting the present invention allows orifices 11 through 14 of respective orifice groups 6Y, 6M, 6C, and 6B, to feed ink by applying independently-provided ink paths $15Y_1$ through $15Y_4$, $15M_1$ through $15M_4$, $15C_1$ through $15C_4$, and $15B_1$ through $15B_4$. This mechanism effectively eliminates the conventional need for an connecting chamber substantially wide enough to cover orifices 11 through 14. Since each ink path is independently provided, even when the printing head 6 is driven at an extremely fast speed, the printing head can minimize influence of G caused by acceleration or deceleration to the printer head, and at the same time the configuration of the printing head embodied by the present invention facilitates even distribution of ink between orifices 11 through 14.

The invention being thus described, it will be obvious that the same may be varied in many ways. However, such variations are not regarded as a departure from the spirit and scope of the invention, and all such modifications are intended to be within the scope of the following claims.

What is claimed is:

1. A printing head for an ink-jet printer which causes said printing head to sequentially execute a printing operation by activating reciprocating movement in the direction crossing the printing paper comprising;

a plurality of orifices which correspond to specific ink colors provided for said printer, said orifices corresponding to respective colors are further incorporated into a plurality of orifice groups, a separate common ink supply corresponding to each of said respective ink colors is provided for each of said orifice groups, an ink pool is positioned in front of each of said orifices, each of said orifices is connected to a separate pressure chamber via a passage, and a separate ink path independent of said passage extends from each said ink pool to said common ink supply having the proper respective ink color.

2. The printing head for an ink-jet printer defined in claim 1, wherein said ink paths respectively extend in the direction perpendicular to the direction of execution of said reciprocating movement.

3. The printing head for an ink-jet printer defined in claim 1, wherein a piezoelectric vibrator is positioned on a side wall of each said pressure chamber.

* * * * *